US012320617B2

(12) United States Patent
Lin

(10) Patent No.: US 12,320,617 B2
(45) Date of Patent: Jun. 3, 2025

(54) REFLEX SIGHT DEVICE

(71) Applicant: Alan Nathan Lin, Arcadia, CA (US)

(72) Inventor: Alan Nathan Lin, Arcadia, CA (US)

( * ) Notice: Subject to any disclaimer, the term of this patent is extended or adjusted under 35 U.S.C. 154(b) by 0 days.

(21) Appl. No.: 18/111,816

(22) Filed: Feb. 20, 2023

(65) Prior Publication Data

US 2024/0280347 A1 Aug. 22, 2024

(51) Int. Cl.
*F41G 1/30* (2006.01)

(52) U.S. Cl.
CPC ..... *F41G 1/30* (2013.01)

(58) Field of Classification Search
CPC ..... F41A 35/02; F41G 1/30; F41G 1/38
USPC ..... 42/143
See application file for complete search history.

(56) References Cited

U.S. PATENT DOCUMENTS

| | | | | |
|---|---|---|---|---|
| 8,904,697 | B2 * | 12/2014 | Park | F41G 1/383 42/129 |
| 10,948,264 | B1 * | 3/2021 | Brumfield | F41G 1/30 |
| 2012/0102804 | A1 * | 5/2012 | Fesas | F41A 3/66 42/90 |
| 2015/0323278 | A1 * | 11/2015 | Pisani | F41A 35/02 42/96 |
| 2017/0102204 | A1 * | 4/2017 | Mezynski | F41G 1/54 |
| 2017/0142301 | A1 * | 5/2017 | Simmon | F41G 11/00 |
| 2022/0026175 | A1 * | 1/2022 | Chavez | F41G 1/30 |
| 2022/0390206 | A1 * | 12/2022 | Hamilton | F41G 1/345 |
| 2022/0390207 | A1 * | 12/2022 | Chavez | F41G 1/01 |
| 2023/0054268 | A1 * | 2/2023 | Schulte | F41G 1/30 |
| 2023/0142324 | A1 * | 5/2023 | Campbell | H04N 23/56 42/113 |
| 2023/0411763 | A1 * | 12/2023 | Sheets, Jr. | H01M 50/247 |
| 2024/0011739 | A1 * | 1/2024 | Smith | F41G 1/38 |
| 2024/0044605 | A1 * | 2/2024 | Sanders | F41C 23/16 |

* cited by examiner

*Primary Examiner* — Michael D David
(74) *Attorney, Agent, or Firm* — Ying-Ting Chen; Law Office of Michael Chen

(57) ABSTRACT

A reflex sight device for a firearm includes a cover body configured to be couplable to a sight and having a vision opening; and a lens shield being detachably covered on the vision opening.

14 Claims, 6 Drawing Sheets

REFLEX SIGHT DEVICE

FIELD OF THE DISCLOSURE

The present disclosure relates to a sight device, and more particularly to a reflex sight device with a cover body covered on the sight and a lens shield covered on a reflective lens of the sight to reduce the interference generated from the UV lights with the light source generated from the reflex sight.

BACKGROUND OF THE DISCLOSURE

Generally, miniature reflex sights, also commonly known as mini red-dot sights, are non-magnifying reflector sights that commonly are used with handguns and small armaments, such as rifles and crossbows. Reflex sights are also used for other aiming purposes, for example as a finder scope for use with a telescope. Reflex sights typically include a partially reflecting transparent element, such as a lens or flat glass element, that the user looks through to view a target and an illuminated aiming mark or reticle pattern. In a reflex sight utilizing a reflecting lens element, the aiming mark is typically generated by a small light emitting diode at the focal point of the lens. In reflex sights including a flat glass element, the aiming mark is generated by an illumination source directed toward the flat glass element.

However, the above-mentioned reflex sight may be cumbersome to use during the exposure to the daylight/sunlight. While the reflex sight is exposed under the sunlight or high intensity of daylight, the UV lights may interfere with the aiming mark, and in such a situation, the user may have a hassle locating the targets, to cause miss-shooting.

There may exist a desire to develop a reflex sight device that can effectively reduce the interference generated from the daylight/sunlight with the aiming mark.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, the reflex sight device for a firearm may comprise a cover body configured to be couplable to a sight and have a vision opening; and a lens shield detachably covered on the vision opening.

In another aspect combinable with the general implementation, the cover body may comprise a housing portion dimensioned to conform with the sight and a base portion configured to lock on the sight.

Among the many possible implementations of the reflex sight device, the cover body may comprise a housing opening where the sight is passed through and a rear vision opening where a light source generated by the sight passes through.

Further, it is contemplated that the cover body is configured to form a housing for receiving the sight placed therein.

In the alternative, the cover body may comprise at least one locking unit formed on an inner surface of the cover body and configured to lock on the sight.

It is still further contemplated that the cover body may comprise at least one locking unit that protrudes from the inner surface of the cover body and is configured to be inserted into the sight.

The contemplated cover body can have at least one adjusting unit formed on side surfaces of the cover body and configured to adjust the effects of a light source generated from the sight.

In one embodiment, the cover body may be configured to cover a top portion of the sight.

In another aspect combinable with the general implementation, the sight may comprise at least one concave slot configured to conform with the locking unit formed on the cover body.

In another aspect combinable with the general implementation, the cover body may comprise at least one locking unit to be inserted into at least one concave slot formed on the sight to affix the cover body on the sight.

In another aspect combinable with the general implementation, the cover body may comprise at least one adjusting unit covered on a portion of the sight, wherein the portion of the sight may be configured to adjust the effects of the light source generated from the sight.

In another aspect combinable with the general implementation, the lens shield may be attached to the inner surface of the cover body to cover the vision opening of the cover body.

In another aspect combinable with the general implementation, the cover body may comprise a rear vision opening aligned with the vision opening, wherein a dimension of the rear vision opening is larger than a dimension of the vision opening.

In another aspect combinable with the general implementation, the cover body may comprise a retaining track being inwardly extended from the inner surface of the cover body and to conform with a dimension of the lens shield.

In another aspect combinable with the general implementation, the lens shield may comprise a lens peripheral edge biased against the retaining track formed along an inner surface of the vision opening to retain the lens shield covering the vision opening.

In another aspect combinable with the general implementation, a light source generated from the sight may be passed through the vision opening and reach the lens shield.

In another aspect, combinable with the general implementation, the lens shield may comprise materials adapted to block ultraviolet lights.

While this specification contains many specific implementation details, these should not be construed as limitations on the scope of any inventions or of what may be claimed but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

A "lens peripheral edge" of the lens shield, as used herein, refers to the external boundary of a lens shield of the invention. In addition, a "peripheral edge" of a vision opening, as used herein, refers to the external boundary of the vision opening of the invention.

Figure 1:
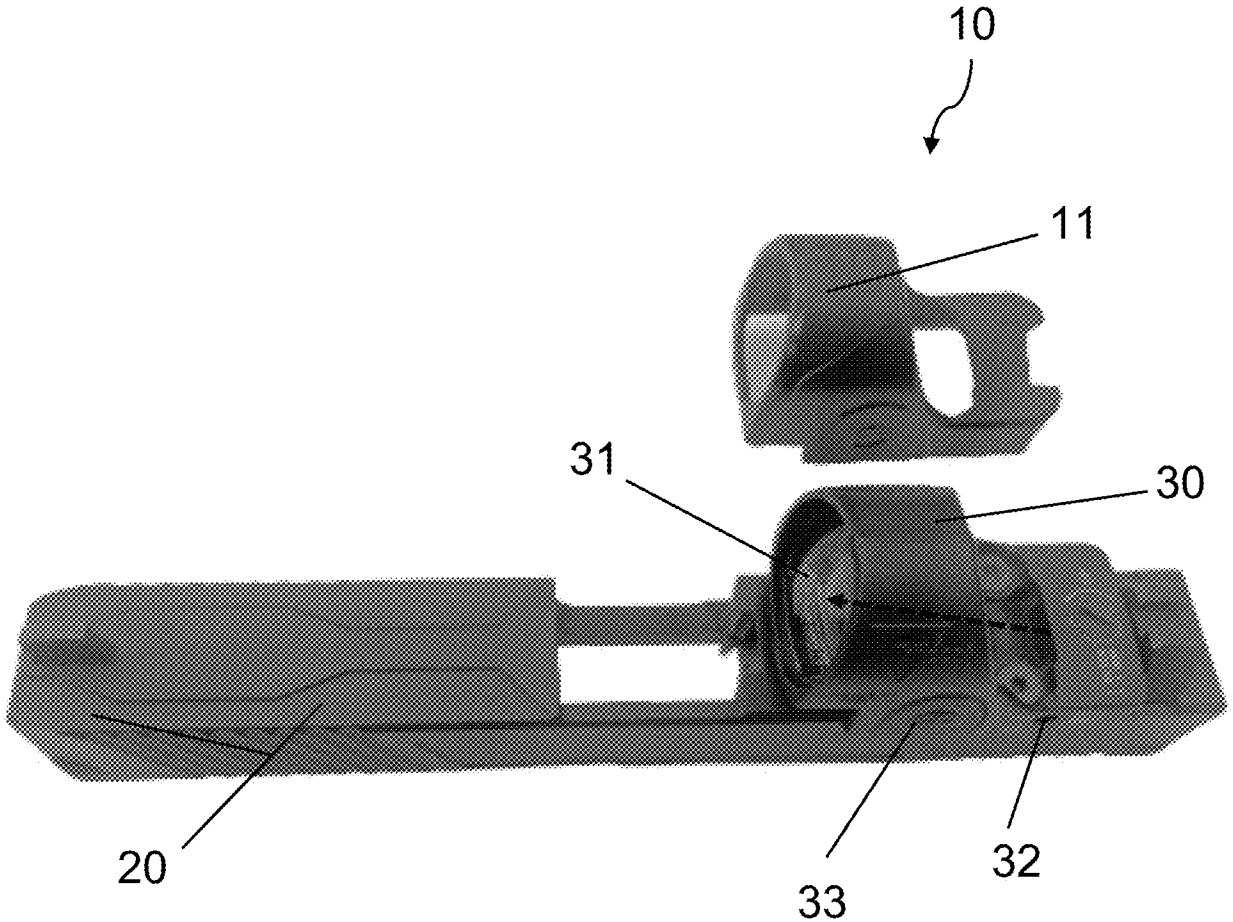
FIG. 1 is a perspective view of a reflex sight device according to an aspect of the embodiment.

FIG. 1 generally depicts a perspective view of a reflex sight device 10 for a firearm 20 according to an aspect of the embodiment.

Referring to FIG. 1, the reflex sight device 10 may comprise a cover body 11 configured to be couplable to a sight 30, wherein the sight 30 may be detachably mounted on the firearm 20. In one embodiment, the sight 30 may generate a light source that may be transmitted to a reflective lens 31 of the sight 30.

Figure 2B:
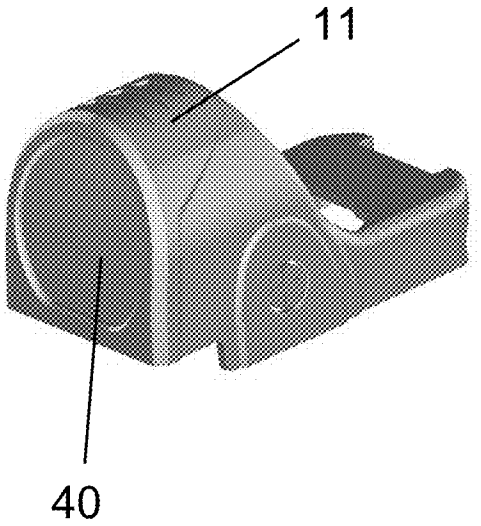
FIGS. 2A-2B are perspective views of a cover body and a lens shield of the reflex sight device according to an aspect of the embodiment.
Figure 2A:
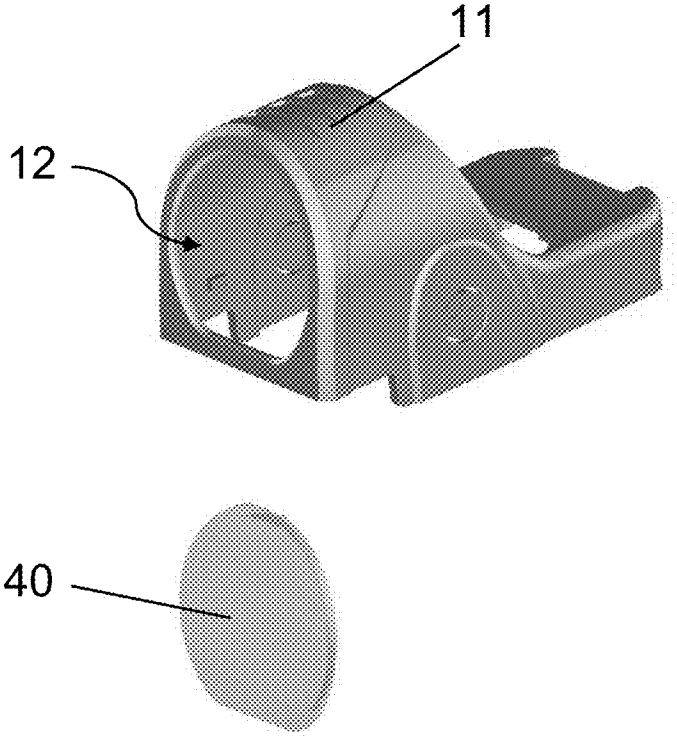

FIGS. 2A-2B generally depict perspective views of the cover body 11 with a lens shield 40 according to an aspect of the embodiment. It is noted that the lens shield 40 can be made of materials adapted with a graded shade to reduce the exposure from the sunlight.

Referring to FIGS. 2A-2B, the cover body 11 may comprise a vision opening 12 formed on a front side of the cover body 11. In one embodiment, the reflex sight device may further comprise a lens shield 40 being detachably covered on the vision opening 12. For example, the vision opening 12 may be fully covered by the lens shield 40. For another example, the vision opening 12 may be partially covered by the lens shield 40.

Figure 3B:
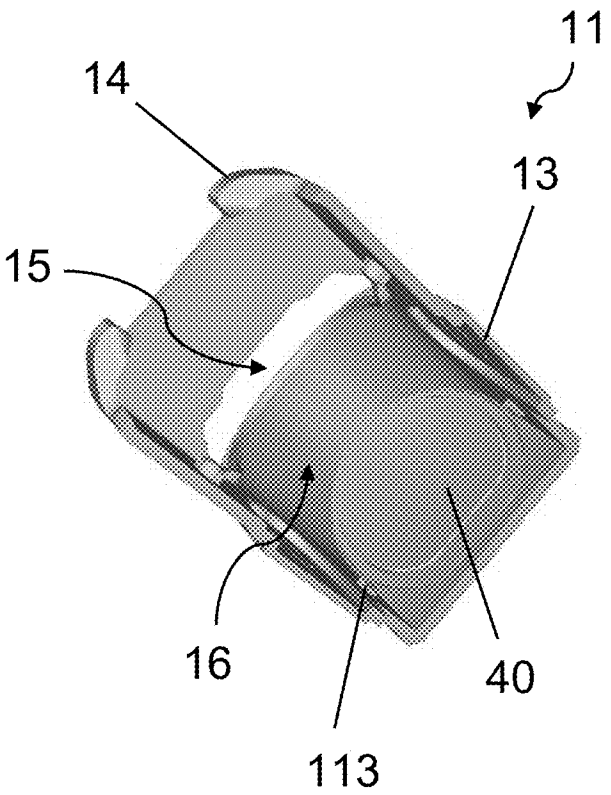
FIGS. 3A-3B are bottom views of the cover body and a lens shield of the reflex sight device according to an aspect of the embodiment.
Figure 3A:
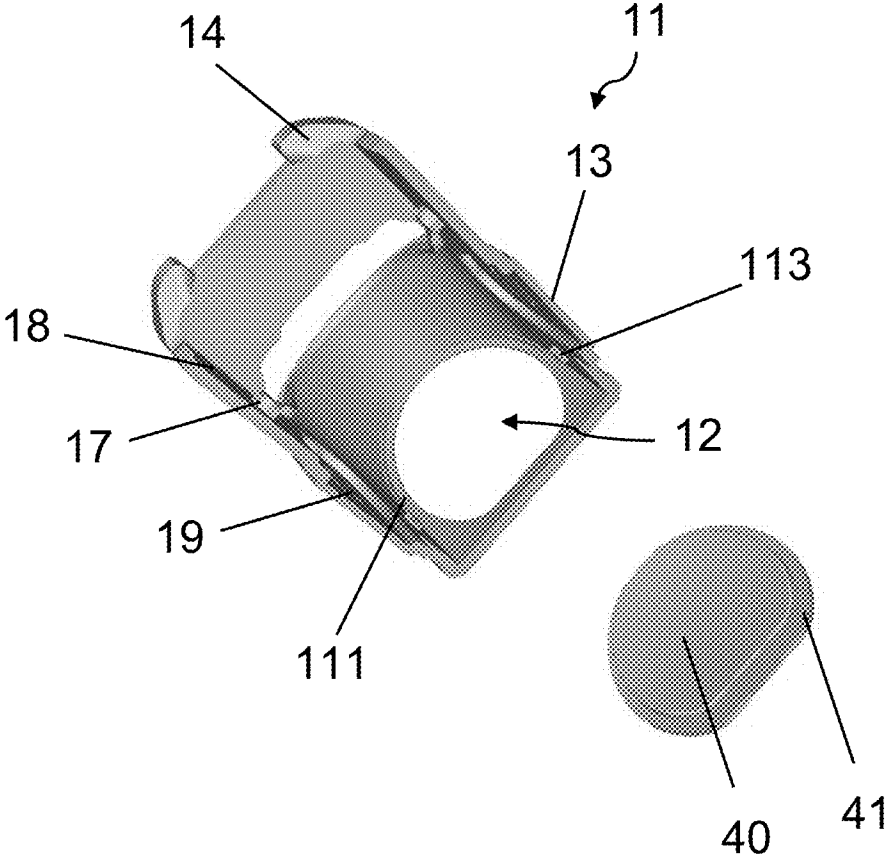

FIGS. 3A-3B generally depict views of the reflex sight device according to an aspect of the embodiment.

In one embodiment, the cover body 11 may further comprise a housing portion 13 dimensioned to conform with the sight and a base portion 14 integrally extended from the housing portion 13, wherein the base portion 14 may be configured to lock on the sight.

Referring to FIG. 3A, the cover body 11 may be dimensioned and configured to form a housing to receive the sight placed therein.

Continuing to FIG. 3B, the cover body 11 may further comprise a rear vision opening 15 formed on a rear side of the cover body 11, wherein the front side of the cover body 11 may be opposite of the front side of the cover body 11. In one embodiment, the cover body 11 comprises a housing opening 16 where the sight may be passed therethrough and the sight may be received inside the cover body 11.

As shown in further detail in FIGS. 3A-3B, the cover body 11 may comprise at least one locking unit 17 formed on an inner surface 18 of the cover body 11 and configured to lock on the sight.

Referring now to the detail of FIG. 3A-3B, in some embodiments, the cover body 11 may comprise at least one locking unit 17 that protrudes from the inner surface 18 of the cover body 11 and is configured to be inserted into the sight. In still some embodiments, the cover body 11 may comprise locking units 17 that protrude from side surfaces of the inner surface 18 of the cover body 11.

It should be noted that in some embodiments, as shown in FIG. 3A, the cover body 11 may comprise at least one adjusting unit 19 formed with penetrating slots on side surfaces of the cover body 11 and configured to adjust effects of the light source generated from the sight with a sensitive touch.

With specific reference to FIGS. 1 and. 3A-3B, the sight 30 may comprise at least one concave slot 32 formed at locations corresponding to locations of the locking unit 17 formed on the cover body 11, wherein the concave slot 32 may be dimensioned and configured to conform with the locking unit 17.

In some embodiments, the cover body 11 may comprise at least one adjusting unit 19 formed on side surfaces of the cover body 11, wherein the adjusting unit 19 may be configured to be covered on a portion 33 of the sight (as shown in FIG. 1). It should be noted that in some embodiments, the portion 33 of the sight 30 may be designed to adjust effects of light source generated from the sight 30. For example, the effects may be color, brightness, or patterns of the light source.

It should be understood that the above-described effects of the light source are exemplary and any other effects of the light source can be adopted in various embodiments of this disclosure.

Turning now to FIGS. 3A and 3B, the cover body 11 comprises a retaining track 111 being inwardly extended from the inner surface 18 of the cover body 11, wherein the retaining track 111 may form along a peripheral edge of the vision opening 12. In one embodiment, the lens shield 40 may comprise a lens peripheral edge 41 formed along a periphery of the lens shield 40. In still one embodiment, the lens peripheral edge 41 of the lens shield 40 may be biased against the retaining track 111 to retain the lens shield 40 covering on the vision opening 12. In other words, in some embodiments, the lens shield 40 may be attached on the inner surface 18 of the cover body 11 to cover the vision opening 12 of the cover body 11.

Continuing to FIGS. 3A to 3B, the cover body 11 may comprise at least one retaining unit 113 that protrudes from the inner surface 18 of the cover body 11 and is configured to be locked on the sight. In still some embodiments, the cover body 11 may comprise the retaining units 113 that protrude from the side surfaces of the inner surface 18 of the cover body 11. In such a manner, while the cover body 11 is attached to the sight, the retaining unit 113 may be biased against the sight so as to provide more fraction forces between the cover body 11 and the sight. Therefore, the retaining unit 113 may be configured to facilitate the cover body 11 being retained on the sight.

Figure 4:
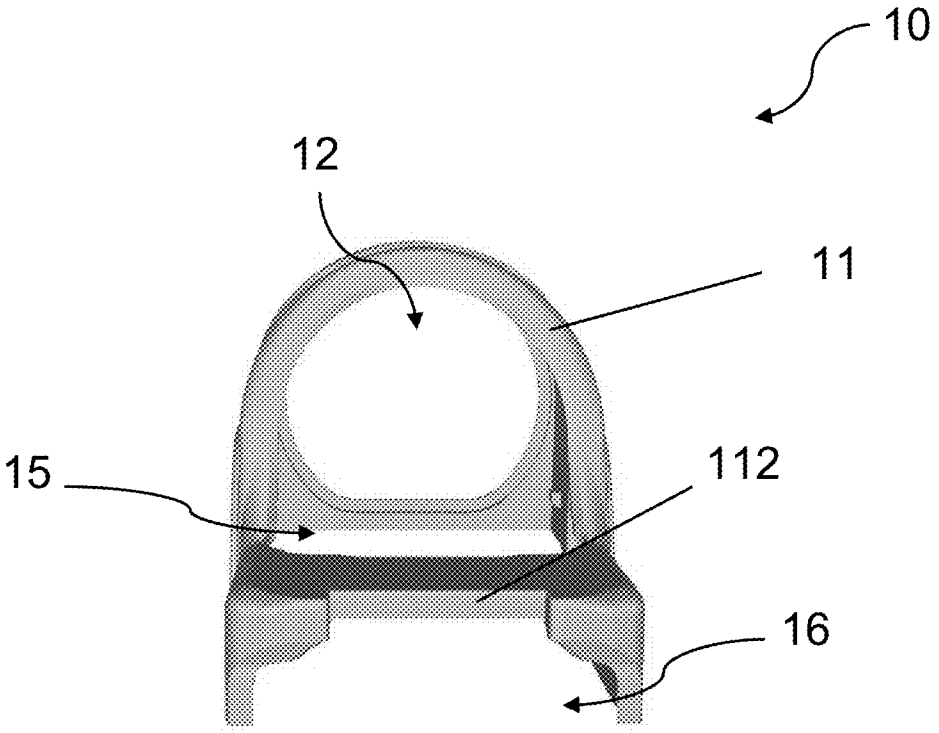
FIG. 4 is a rear view of the cover body of the reflex sight device according to an aspect of the embodiment.

FIG. 4 generally depicts a rear view of the cover body 11 of the reflex sight device 10 according to an aspect of the embodiment.

Referring to FIG. 4, the cover body 11 may comprise the rear vision opening 15 aligned with the vision opening 12. In one embodiment, a dimension of the rear vision opening 15 may be larger than a dimension of the vision opening 12. In still one embodiment, the dimension of the rear vision opening 15 may be smaller than the dimension of the vision opening 12. It should be noted that the dimension of the rear vision opening 15 and the dimension of the vision opening 12 may be predesigned to satisfy the needs of the shooting purpose or the styles of the sight.

Figure 5:
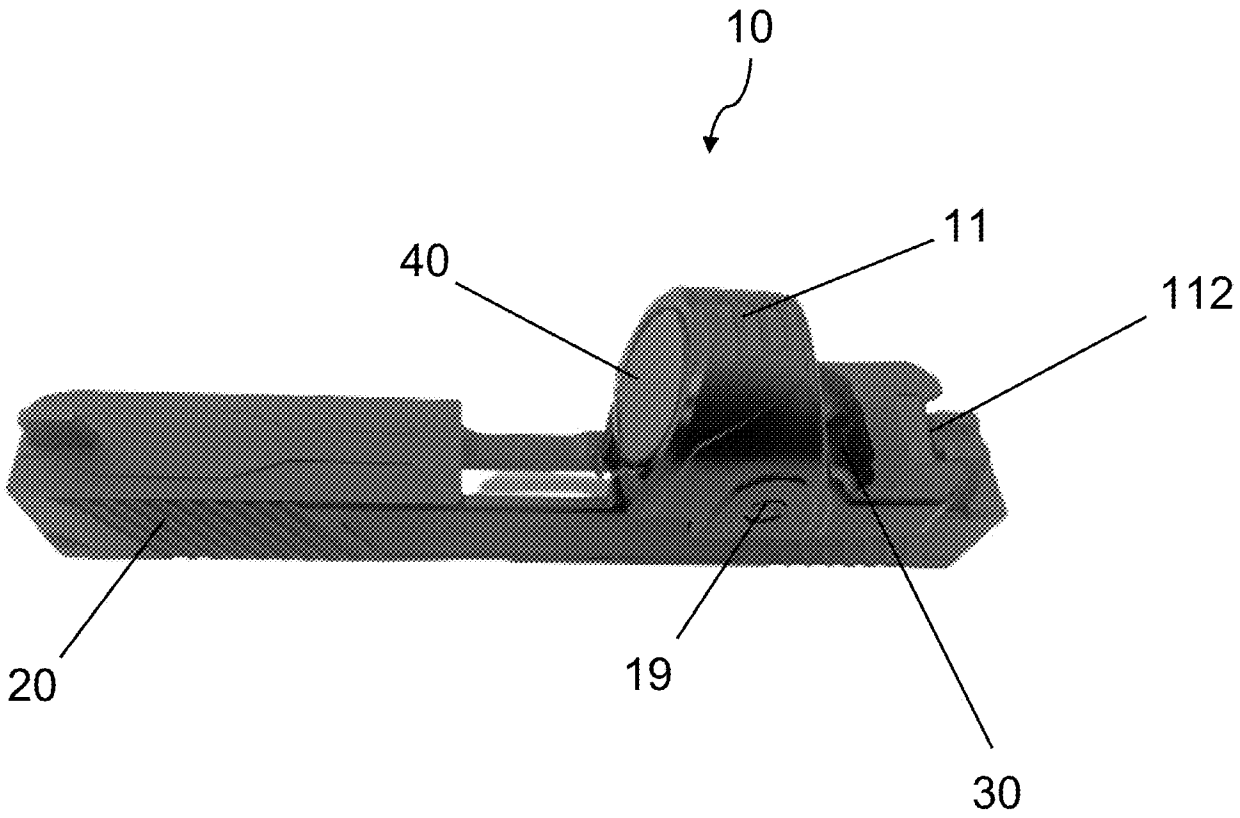
FIG. 5 is a perspective view of the reflex sight device showing the cover body and the lens shield covered on the sight according to an aspect of the embodiment.
Figure 6:
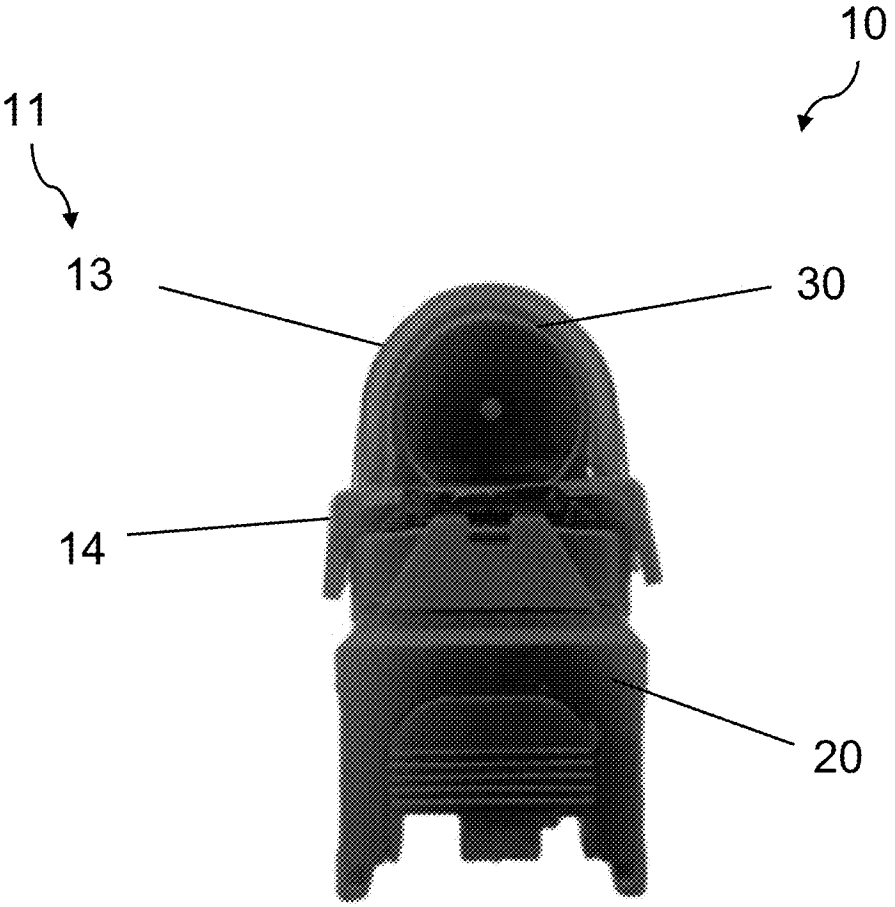
FIG. 6 is a rear view of the reflex sight device showing the cover body and the lens shield covered on the sight according to an aspect of the embodiment.

FIGS. 5-6 generally depict views of the reflex sight device 10 mounted on the firearm 20 according to an aspect of the embodiment.

Referring to FIGS. 5-6, in one embodiment, the housing portion 13 of the cover body 11 may be configured to cover on a top portion of the sight 30 and the base portion 14 of the cover body 11 may be coved on a bottom portion of the sight 30. And, in such a way, in still one embodiment, the locking unit 17 (as shown in FIGS. 3A and 3B) of the cover body 11 may be inserted into the at least one concave slot 32 (as shown in FIG. 1) formed on the sight 30 to affix the cover body 11 on the sight 30.

In one embodiment, the dimension of the cover body 11 may be dimensioned to conform with the dimension of the sight 30 to allow the sight 30 to be received inside the cover body 11. As shown in further details in FIG. 5, the lens shield 40 may comprise materials adapted to block ultraviolet lights, and in such a way, while the light source generated from the sight is transmitted to the reflective lens 31 (as shown in FIG. 1), the light source may interfere with UV lights while the shooter fires the firearm 20. Therefore, the lens shield 40 may reduce the UV light interference to facilitate the shooter during firing.

It should be understood that the above-described UV lights are exemplary and any other daylights or light source can be adopted in various embodiments of this disclosure.

According to the above-mentioned embodiments, the light source generated from the sight 30 may be passed through the vision opening 12 and the rear vision opening 15 and may further reach the lens shield 40.

Referring now to the details of FIGS. 4-6, the cover body 11 may further comprise an indented edge 112 formed on a rear portion of the cover body 11, wherein the vision opening 12 may be formed on a front portion of the cover body 11. The rear portion of the cover body 11 may be opposite of the front portion of the cover body 11. It should be noted that, in some embodiments, the indented edge 112 may be utilized to facilitate the cover body 11 being detached from the sight 30. In still another embodiment, the indented edge 112 may be configured to facilitate additional firearm accessories being mounted on the firearm.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the reflex sight device have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structures, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A reflex sight device for a firearm, comprising:

a cover body configured to be couplable to a sight and having a vision opening; and a lens shield being detachably covered on the vision opening, wherein the cover body, configured to form a housing for receiving the sight placed therein, comprises a housing portion dimensioned to conform with the sight and a base portion configured to lock on the sight, and the cover body comprises a housing opening where the sight is passed through and a rear vision opening where a light source generated from the sight passes through, wherein the cover body further comprises at least one adjusting unit formed with penetrating slots on side surfaces of the cover body and configured to adjust effects of a light source generated from the sight with a sensitive touch.

2. The reflex sight device of claim 1, wherein the cover body comprises at least one locking unit formed on an inner surface of the cover body and configured to lock on the sight.

3. The reflex sight device of claim 1, wherein the cover body comprises at least one locking unit that protrudes from an inner surface of the cover body and is configured to be inserted into the sight.

4. The reflex sight device of claim 1, wherein the cover body is configured to cover a top portion of the sight.

5. The reflex sight device of claim 1, wherein the sight comprises at least one concave slot dimensioned to conform with a locking unit formed on the cover body.

6. The reflex sight device of claim 1, wherein the cover body comprises at least one locking unit to be inserted into at least one concave slot formed on the sight to affix the cover body on the sight.

7. The reflex sight device of claim 1, wherein the cover body comprises at least one adjusting unit covered on a portion of the sight, wherein the portion of the sight is configured to adjust effects of light source generated from the sight.

8. The reflex sight device of claim 1, wherein the lens shield is attached to an inner surface of the cover body to cover the vision opening of the cover body.

9. The reflex sight device of claim 1, wherein the cover body comprises a rear vision opening aligned with the vision opening, wherein a dimension of the rear vision opening is larger than a dimension of the vision opening.

10. The reflex sight device of claim 1, wherein the cover body comprises a retaining track being inwardly extended from an inner surface of the cover body to conform with a dimension of the lens shield.

11. The reflex sight device of claim 1, wherein the lens shield comprises a lens peripheral edge biased against a retaining track formed along an inner surface of the vision opening to retain the lens shield covering the vision opening.

12. The reflex sight device of claim 1, wherein a light source generated from the sight is passed through the vision opening and reaches the lens shield that made of materials adapted with a graded shade to reduce the exposure from the sunlight.

13. The reflex sight device of claim 1, wherein the cover body comprises an indented edge formed on a rear portion of the cover body and configured to facilitate the cover body being detached from the sight.

14. The reflex sight device of claim 1, wherein the cover body comprises at least one retaining unit that protrudes from side surfaces of an inner surface of the cover body and is configured to be biased against the sight to provide more fraction forces between the cover body and the sight.

* * * * *